US007645097B2

(12) United States Patent
Canteri

(10) Patent No.: US 7,645,097 B2
(45) Date of Patent: Jan. 12, 2010

(54) METHOD FOR SATURATING CAVITIES PRESENT IN A MASS OF SOIL OR IN A BODY IN GENERAL

(75) Inventor: Carlo Canteri, Bosco Chiesanuova (IT); Mariapia Pastor, legal representative, Bosco Chiesanuova (IT)

(73) Assignee: Uretek S.r.l., Bosco Chiesanuova (IT)

( * ) Notice: Subject to any disclaimer, the term of this patent is extended or adjusted under 35 U.S.C. 154(b) by 158 days.

(21) Appl. No.: 11/666,167

(22) PCT Filed: Oct. 24, 2005

(86) PCT No.: PCT/EP2005/011388

§ 371 (c)(1),
(2), (4) Date: Apr. 25, 2007

(87) PCT Pub. No.: WO2006/050807

PCT Pub. Date: May 18, 2006

(65) Prior Publication Data

US 2008/0205995 A1 Aug. 28, 2008

(30) Foreign Application Priority Data

Nov. 9, 2004 (IT) ..... MI2004A2149

(51) Int. Cl.
*E02D 3/12* (2006.01)

(52) U.S. Cl. ..... 405/267; 405/263

(58) Field of Classification Search ..... 405/263, 405/266, 267
See application file for complete search history.

(56) References Cited

U.S. PATENT DOCUMENTS

| | | | | |
|---|---|---|---|---|
| 1,391,678 | A * | 9/1921 | Francois | 405/266 |
| 2,958,905 | A | 11/1960 | Newberg et al. | |
| 3,098,754 | A | 7/1963 | Dixon | |
| 3,508,407 | A * | 4/1970 | Booth | 405/264 |
| 3,637,019 | A | 1/1972 | Lee | |
| 4,331,975 | A * | 5/1982 | Krawza et al. | 348/85 |
| 4,694,437 | A * | 9/1987 | Hanson | 367/27 |
| 4,744,700 | A | 5/1988 | Andy et al. | |
| 2002/0098042 | A1 * | 7/2002 | Canteri | 405/40 |
| 2005/0081459 | A1 * | 4/2005 | Moroschan | 52/169.1 |

* cited by examiner

*Primary Examiner*—John Kreck
(74) *Attorney, Agent, or Firm*—Modiano & Associati; Albert Josif; Daniel J. O'Byrne

(57) ABSTRACT

A method for saturating cavities present in a mass of soil or in a body in general, comprising at least one step for at least partial filling of the cavity by introducing into the cavity a filler material in the solid state or in the fluid state and capable of setting. At least one step of saturating the cavity is then performed by introducing into the cavity a fluid synthetic substance which expands and sets by chemical reaction. The synthetic substance is adapted to generate, as a consequence of its expansion, at least the saturation of the cavity and a compaction and/or loading of the filler material introduced into the cavity in the filling step, creating an optional state of permanent tension on the walls that delimit the cavity, to the point of producing, if necessary, a deformation of the walls.

59 Claims, 2 Drawing Sheets

METHOD FOR SATURATING CAVITIES PRESENT IN A MASS OF SOIL OR IN A BODY IN GENERAL

The present invention relates to a method for saturating cavities present in a mass of soil or in a body in general, such as a body of a built structure, so as to produce optionally a state of permanent tension on the walls of said cavity such as to generate, if necessary, a deformation of the walls. More particularly, the method according to the present invention allows to generate mutual contact among the elements that constitute the material used to fill a cavity and, if necessary, allows to apply to the walls of said cavity a state of permanent tension which can optionally produce an expansion of the volume of the saturated cavity. More generally, the method according to the invention can be used to produce continuity between different volumes of soil interrupted by natural or man-made cavities (the most frequent examples relate to large karst cavities, tunnels or mines no longer in use, underground reservoirs, ancient crypts, et cetera) and to fill cavities above the ground (structural gaps, reservoirs, etc).

BACKGROUND OF THE INVENTION

Underground or above-ground cavities can constitute a problem as regards distribution of the stresses within a mass of soil or more generally within a body. Said cavities in fact constitute a discontinuity which, as such, does not cooperate in the distribution of the stresses within a volume.

Consider for example a cavity in a mass of soil located at the footing of a tall building. According to the laws of geotechnical engineering, in such a situation the load of the building is transferred to the soil unevenly, concentrating proximate to the surface that surrounds the cavity. In extreme cases, this load concentration can even reach and exceed the ultimate strength of the soil, with consequent collapse of the entire volume and accordingly of everything that rests thereon.

Various methods are known for filling underground cavities by using various types of materials.

In general, these methods have the goal of filling the entire volume of the cavity by means of setting liquid substances optionally mixed with inert solid filler material.

In particular, European Patent Application no. 0114448 discloses a method for partially or totally filling cavities by pumping a cement-based foaming material, which contains an inorganic expanded material such as pearlite and vermiculite. This method, despite being very expensive, does not ensure the complete filling of underground cavities with domed surfaces having an irregular geometry, since the expansion of the inorganic material is provided before pouring for filling and therefore the final distribution of the solidified mixture within the cavity follows a geometry which is governed only by the force of gravity.

Japanese Patents no. 09-228371 and no. 11-323904 disclose methods for filling cavities which are based on the separate use of granular solid material, optionally with the addition of lubricating foaming agents, for filling the easily accessible voids and subsequently of cement mortar or other materials in the fluid state, which are poured into the cavity in order to saturate the intergranular voids of the previously deposited solid material and fill the portions of the cavity that have not yet been reached. Even with these methods, saturation of the dome of the cavity is not possible, since the mortar or other material in the fluid state, due to the force of gravity, tends to settle on the bottom before solidifying. Moreover, the execution cost of this method can be very high, since complete saturation of the intergranular voids can entail the use of large quantities of mortar or other material in the fluid state. Finally, the considerable weight increase that the filling mixture produces on the ground underneath the filled cavity must not be neglected.

Another cavity filling technique is disclosed in Japanese Patent no. 2002-348849, according to which the filling mixture is injected into the cavity until preset injection pressures are recorded and in any case until said mixture exits from holes provided adjacent to the injection duct. This technique, in addition to suffering the disadvantages already noted with reference to the methods described above, can entail, in the case of underground cavities with fractured walls, very high execution costs, due to the disproportionate use of mixture with respect to the volume of the cavity to be saturated.

Another method which has the disadvantage of being unable to saturate the volume in the dome is the one disclosed in US Patent Application no. 2002/0015619. This method consists in plugging the underground cavities by using only solid inert material assisted by a lubricating foaming agent which facilitates its arrangement in the void.

Other known types of methods for filling underground cavities use expanding synthetic filler materials. For example, the methods disclosed in U.S. Pat. No. 3,478,520 and U.S. Pat. No. 4,744,700 use expanding synthetic material such as polystyrene, which increases in volume if it is placed in contact with heat sources. The methods for applying heat to the expanding synthetic material can be of various kinds. This method, which is unquestionably very expensive, is difficult to apply both as regards providing, if needed, a sufficient heat source and as regards distributing uniformly the heat within the cavity, allowing even expansion of the expanding synthetic material contained therein.

SUMMARY OF THE INVENTION

The aim of the present invention is to provide a method for saturating cavities present in a mass of soil or in a body in general in order to restore its continuity which is capable of solving the problems described above with reference to known types of methods.

Within this aim, an object of the invention is to provide a method which allows to generate mutual contact among the elements that constitute the material used to fill a cavity, compacting it, and allows to apply to the walls of said cavity an optional state of permanent tension, which can generate, if required, an expansion of said walls.

Another object of the invention is to provide a method which can be performed in a short time and with compact equipment.

Another object of the invention is to provide a method which can be performed in absolute safety even in the immediate vicinity of dwellings and with limited space available.

This aim and these and other objects, which will become better apparent hereinafter, are achieved by a method for saturating cavities present in a mass of soil or in a body in general, characterized in that it comprises:

- at least one step of at least partial filling of the cavity by introducing a filler material into the cavity;
- at least one step of saturating the cavity by introducing into said cavity a fluid synthetic substance which expands and sets by chemical reaction and is adapted to generate, as a consequence of its expansion, at least the saturation of the cavity and a compaction and/or loading of said filler material introduced into the cavity in said filling step.

BRIEF DESCRIPTION OF THE DRAWINGS

Further characteristics and advantages of the invention will become better apparent from the description of a preferred but not exclusive embodiment of the method according to the invention, illustrated by way of non-limiting example in the accompanying drawings, wherein.

DESCRIPTION OF THE PREFERRED EMBODIMENTS

With reference to the figures, the method according to the invention substantially comprises at least one step of filling at least partially the cavity 1 by introducing in the cavity 1 a filler material 3, which is constituted by an inert material in the solid state, preferably in granules, or by a material in the fluid state which can solidify, and at least one step of saturating the cavity 1 by introducing in said cavity 1 a fluid synthetic substance 4 which expands and hardens by chemical reaction and is adapted to produce, as a consequence of its expansion, at least the saturation of the cavity 1 and a compaction and/or loading of the filler material 3 introduced in the cavity 1 during the filling step.

The term "saturation" with reference to the function performed by the synthetic substance 4 is used to intend that the synthetic substance 4 fills the spaces of the cavity 1 that have not been reached by the filler material 3 during the filling step and any macroscopic spaces that are present in the filler material 3, without thereby necessarily affecting also all the minimal spaces, such as the intergranular spaces of the material 3, if said material is constituted by inert material in granules.

The quantity of synthetic substance 4 introduced in the cavity 1 during the saturation step and its degree of expansion by chemical reaction are preferably adapted to produce, as an effect of the expansion of the synthetic substance 4, a state of permanent tension on the walls 2 which delimit the cavity 1, to the point of optionally producing, if required, an outward deformation of said walls 2 of the cavity 1.

Figure 1:
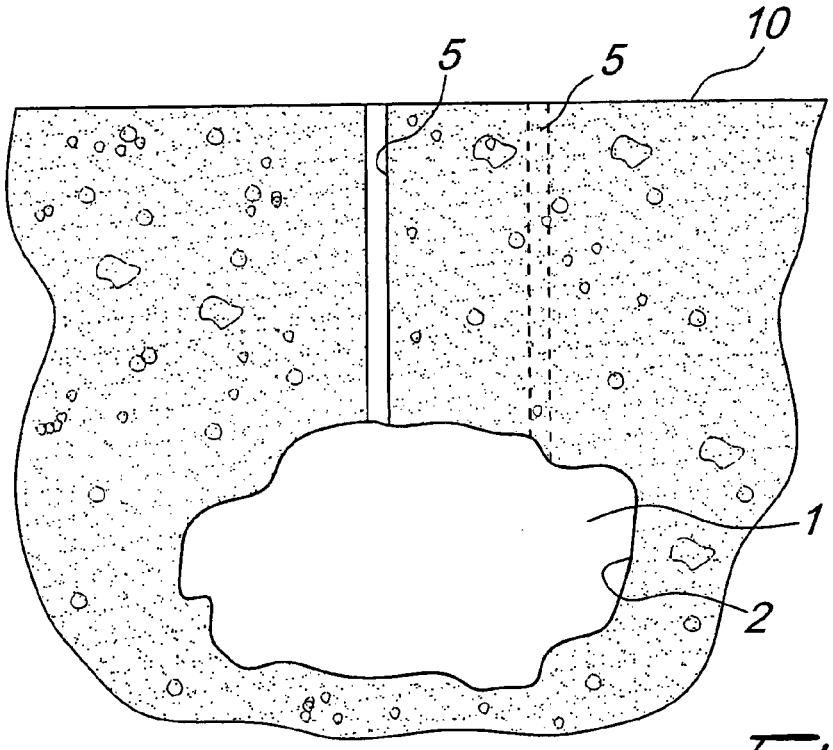
FIGS. 1 to 4 are schematic views of the execution of the method according to the invention for saturating an underground cavity.

More particularly, before the filling step, the method according to the invention comprises a first preparation step, in which first holes 5 for connecting the cavity 1 to the outside (FIG. 1) are formed in the region of the mass of soil or of the body in general which is comprised between the cavity 1 and a working surface 10 located outside the mass of soil or the body in general.

In the preferred embodiment illustrated in the figures, which relates to a particularly advantageous application of the method according to the invention in the filling of an underground cavity 1, the working surface 10 is located above the cavity 1 and the first holes 5 lie substantially vertically or are inclined with respect to a vertical direction.

In any case, it may occur that the most convenient working surface does not lie above the cavity but is located laterally or even below it.

The first holes 5 are provided in such a manner that the distance between two contiguous holes 5 ranges preferably from 1 m to 20 m.

The diameter of the first holes 5 ranges preferably from 15 mm to 300 mm.

The length of the first holes 5 may vary according to the conditions of the soil and according to the operating requirements and must be at least such as to allow to reach, from the working surface, the surface that delimits the underground cavity 1.

Figure 3:
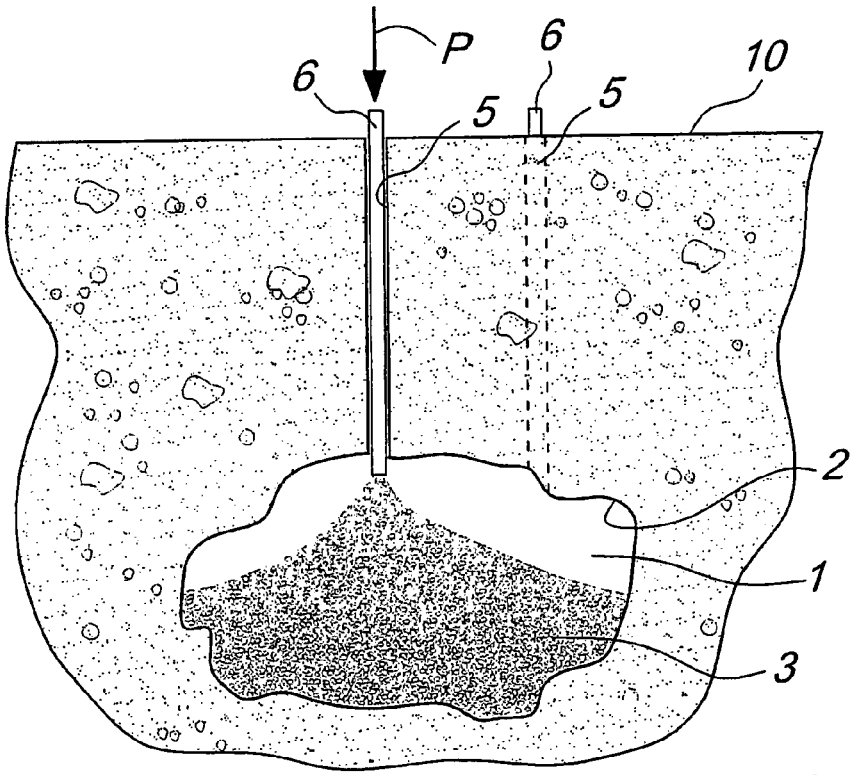

The filling step is then performed; during this step, the filler material 3 is introduced in the cavity 1, preferably by means of a pump P (FIG. 3) through the first holes 5.

Preferably, during this filling step the filler material 3 is introduced in the cavity 1 through first pipes 6 inserted beforehand in the first holes 5.

The first pipes 6 preferably have a diameter ranging substantially from 10 mm to 250 mm.

The first pipes 6 can be made of steel, PVC, or other suitable material and are connected, at their end which protrudes from the ground, to the flexible hose that arrives from the pump.

The filler material 3 can be constituted by a material in the fluid state, which solidifies over time, or by an inert material in the solid state, preferably in granules, which is conveyed through the first pipes 6 with the aid of a conveyance fluid such as air, water, foaming agent, or others.

If the filler material 3 is constituted by a material in the fluid state, said material can have a density ranging substantially from 20 $kg/m^3$ to 2400 $kg/m^3$.

The solidification time of the fluid filler material 3 ranges from 30 seconds to 24 hours.

The simple compressive strength of the fluid filler material 3, once solidified, ranges from 1.50 $kg/cm^2$ to 500 $kg/cm^2$.

The modulus of deformation of the fluid filler material 3, once solidified, ranges from 30 $kg/cm^2$ to 400,000 $kg/cm^2$.

Merely by way of indication, concrete or any other chemical compound can be used as a fluid filler material 3.

Examples of a suitable chemical compound are the aminaplast-duroplasts, such as urea-melamin-aldehyde foam.

If the filler material 3 is constituted by an inert material in the solid state in granules, it preferably has a density substantially ranging from 200 $kg/m^3$ to 2000 $kg/m^3$.

The simple compressive strength of the individual granules or elements which constitute the solid filler material 3 preferably ranges from 5 $kg/cm^2$ to 2000 $kg/cm^2$.

The internal friction angle of the solid filler material 3 ranges from 20° to 45°.

The modulus of deformation of the solid filler material 3 ranges from 250 $kg/cm^2$ to 800,000 $kg/cm^2$.

The size of the granules that constitute the solid filler material 3 ranges from 0.001 mm to 50 mm.

Merely by way of example, sand and/or gravel, expanded clay or waste of industrial processes can be used as inert materials in granules.

After the filling step and before the saturation step, the method according to the invention can comprise a second preparation step, during which, starting from the working surface 10, second holes 7 are provided which lead into the cavity 1 above the filler material 3 and/or into the filler material 3.

The second holes 7 lie substantially vertically or along a direction which is inclined with respect to a vertical direction in the volume of soil comprised between the working surface 10 and the surface that delimits the underground cavity 1 to be saturated, and can also affect the filler material 3 previously introduced in the cavity 1.

Preferably, the distance between two contiguous holes of the second holes 7 ranges substantially from 1 m to 20 m.

The diameter of the second holes 7 ranges preferably from 10 mm to 100 mm.

Figure 4:
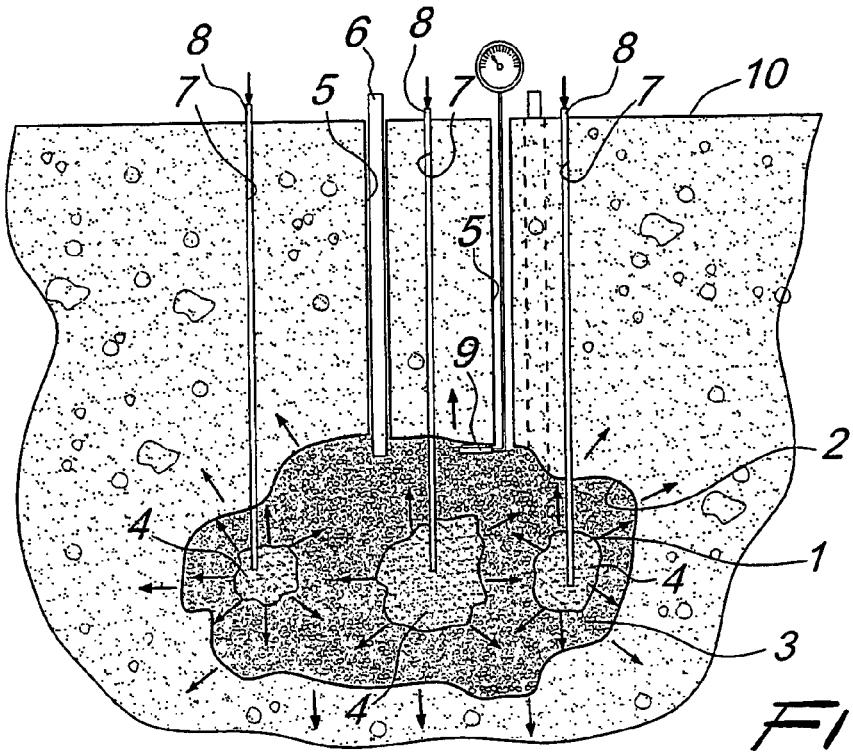

During the saturation step, the synthetic substance 4 is introduced in the cavity 1 through the second holes 7, but it might be possible to use partially or fully also the first holes 5 for this purpose. Preferably, the synthetic substance 4, during the saturation step, is injected into the cavity 1 by pumping through second pipes 8, which are inserted, before the pumping of the synthetic substance 4, into the second holes 7 and/or into the first holes 5 (FIG. 4).

The second pipes 8 preferably have a diameter ranging substantially from 6 mm to 50 mm.

If the second pipes 8 have a diameter which is much smaller than the holes 5 or 7 in which they are inserted, they are arranged within the holes 5 or 7 by using a plugging bag, which is adapted to prevent the reverse flow toward the surface of the synthetic substance 4 and to anchor the pipe 8 in the hole 5 or 7.

The second pipes 8 can be made of copper, steel, PVC, or other suitable material that is compatible with the materials used and the pumping conditions.

The synthetic substance 4 used in the step of saturation following expansion by chemical reaction preferably has a potential volume increase ranging substantially from 2 to 30 times, preferably from 10 to 30 times, its initial volume, i.e., its volume before expansion. The expression "potential expansion" is understood to refer to the expansion that the synthetic substance 4 would undergo if its expansion occurred freely in the atmosphere. The actual expansion of the synthetic substance 4 is inversely proportional to the resistance that the filler material 3 and the walls 2 of the cavity 1 oppose to said expansion when the synthetic substance 4 is pumped into the cavity 1.

The maximum expansion pressure generated by the synthetic substance 4 during expansion is greater than the pressure produced by the weight of the filler material that is present above the outlet of the second pipes 8 in the cavity, so as to achieve, by way of the expansion of the synthetic substance 4, good compaction and/or loading of the filler material 3 against all the walls 2 of the cavity 1, completely filling any voids in the dome and generating a state of tension on the walls 2, with possible outward deformation of said walls 2. The maximum expansion pressure of the synthetic substance 4 depends on the composition of the synthetic substance and increases with the resistance opposed by the filler material 3 and by the walls 2 of the cavity 1 to this expansion.

The maximum expansion pressure of the synthetic substance in fully confined conditions ranges conveniently from 200 kPa to 20,000 kPa, preferably higher than 500 kPa.

The expansion of the synthetic substance 4 produces a compaction and/or loading of the filler material 3, further achieving, if said filler material 3 is constituted by material in granules, mutual contact among the granules that compose it.

The synthetic substance 4 is a substance composed of at least two components, which are mixed in an appropriate apparatus and are pumped into the second pipes 8, preferably with a pressure ranging from 5 to 30 bars.

The synthetic substance 4 preferably has a reaction time, understood as the time interval between when the components are mixed and when the expansion begins, which ranges substantially from 2 to 80 seconds, preferably from 2 to 15 seconds.

The reaction time of the synthetic substance 4 is such as to allow said substance to flow correctly through the second pipes 8 without plugging them and at the same time limit considerably the dispersion of said substance before expansion within the small voids that exist between the granules or elements which constitute the filler material 3. This allows, by virtue of the expansion of the synthetic substance 4, to compact the filler material 3 and to push it even into the dome or into the interstices of the cavity 1 and/or fill them directly, thus filling completely and totally the cavity 1, at the same time allowing a considerable saving of expanding substance 4, which is very expensive, and of production times. It must in fact be considered that the total volume of all the small voids that exist among the granules or elements which constitute the filler material 3 (if said material is constituted by solid material in granules), after the complete filling of a cavity 1, creating an optional state of permanent tension on the walls 2 which delimit the cavity 1 to the point of producing, if necessary, a deformation of said walls 2, can be even equal to 20-30% of the total volume of said cavity 1.

Again for this purpose, the viscosity of the synthetic substance 4 before the chemical reaction for expansion, ranges preferably from 100 mPa·s to 700 mPa·s at the temperature of 25° C.

Moreover, the viscosity of the synthetic substance 4 passes from this value to a value which tends to infinity over a time interval ranging from 5 seconds to 80 seconds starting from the beginning of the chemical reaction for expansion.

The synthetic substance 4 is constituted preferably by a closed-cell polyurethane foam.

Said synthetic substance 4 is constituted preferably by an MDI isocyanate and by a mixture of polyols.

Merely by way of example, the MDI isocyanate can be constituted by the product URESTYL® 10, manufactured by the Dutch company Resina Chemie, while the mixture of polyols comprises a polyether polyol and/or a polyester polyol, a catalyst and water, like the product RESINOL® AL 1409 manufactured by the same company.

The mixing of these two components produces an expanding polyurethane foam whose density, at the end of expansion in the atmosphere, i.e., without any confinement, is approximately 30 kg/m$^3$ and varies depending on the resistance opposed to the expansion to which it is subjected, up to a maximum of 1200 kg/m$^3$ in fully confined conditions. Generally, the density of the synthetic substance 4, following its injection into the cavity 1 and into the filler material 3, after expansion, varies from 50 kg/m$^3$ to 200 kg/m$^3$.

The synthetic substance 4, once injected and set, preferably has a tensile strength substantially ranging from 0.3 MPa to 1.9 MPa and a compressive strength ranging substantially from 0.2 MPa to 2.4 MPa, respectively at the densities of 50 kg/m$^3$ and 200 kg/m$^3$.

Moreover, the modulus of elasticity of the synthetic substance 4 after its expansion and setting can be of the same order of magnitude as the modulus of elasticity of the soil that surrounds the cavity 1 and of the filler material 3, so as to ensure complete cooperation both between the two materials contained in the cavity 1 and between the filling of the cavity 1 and the surrounding soil in any state of deformation occurring on site, i.e., with a value ranging substantially from 10 MPa to 50 MPa, respectively at the densities of 50 kg/m$^3$ and 200 kg/m$^3$.

The result of the method according to the invention can be assessed by installing, at the intrados of the cavity 1, at the selected points, pressure measurement units 9, which detect the increase in the state of tension between the filler material 3 and the walls 2 of the cavity during the execution of the saturation step.

In particular, the pressure measurement units 9 can be lowered into the cavity 1, before performing the saturation step, through the first holes 5 used to introduce the filler material 3 during the filling step.

Figure 2:
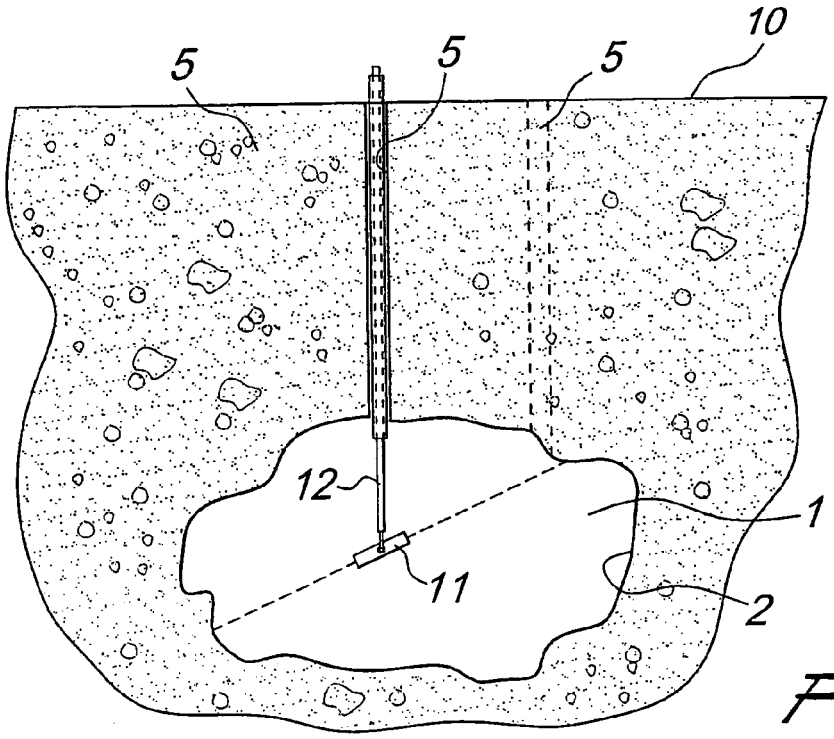

The volume of the cavity 1 to be saturated can be viewed beforehand by means of a television camera 11, optionally of the infrared type, and measured with a laser measuring instrument, such as a laser rangefinder. Both instruments, optionally arranged on a rigid rod 12, are lowered temporarily into the cavity 1 through the first holes 5 and rotated inside the cavity 1 so as to travel along the main directions (FIG. 2).

In practice, it has been found that the method according to the invention fully achieves the intended aim, since it is capable of ensuring the complete filling of cavities and the optional tensioning of the walls that delimit said cavities, eliminating the previous effect of structural discontinuity caused by the presence of the cavities.

Moreover, the method according to the invention can be performed with distinctly lower costs and shorter times than required by known types of methods and can be performed with compact equipment and even in the immediate vicinity of dwellings and if limited space is available.

One particular advantage of the method according to the invention is that it requires the use of very small amounts of expanding synthetic substance, since the synthetic substance, by virtue of its viscosity before expansion, of its expansion time and of its great increase in viscosity from when it begins to expand, disperses very little among the interstices of the filler material that is used in the filling step and in any cracks in the walls that delimit the cavity to be saturated, despite being able to achieve excellent compaction and/or loading of the filler material and the optional tensioning of the walls that delimit the cavity.

Although the method according to the invention has been conceived particularly for saturating underground cavities, it can in any case be used also to saturate cavities above ground, such as for example structural gaps, reservoirs, et cetera, or for bodies in general, such as built bodies including underground garages, storage basements etc.

The method thus conceived is susceptible of numerous modifications and variations, all of which are within the scope of the appended claims; all the details may further be replaced with other technically equivalent elements.

The disclosures in Italian Patent Application No. MI2004A002149 from which this application claims priority are incorporated herein by reference.

What is claimed is:

1. A method for saturating cavities present in a body mass comprising:

at least one step of at least partial filling of a cavity by introducing a filler material into the cavity;

at least one step of saturating the cavity by introducing into said cavity a quantity of a fluid synthetic substance which expands and sets by chemical reaction and is adapted to generate, as a consequence of its expansion, at least the saturation of the cavity and a compaction and/or loading of said filler material introduced into the cavity in said filling step, wherein during execution of said at least one step for saturating the cavity a pressure applied to walls of said cavity by said synthetic substance during its expansion is measured.

2. The method of claim 1, wherein said fluid synthetic substance has a viscosity and an expanding chemical reaction time which are adapted to produce only partial filling of any interstices present in said filler material and/or any cracks present in walls that delimit the cavity.

3. The method of claim 1, wherein the quantity of said fluid synthetic substance introduced in the cavity during said saturation step and an expansion degree thereof by chemical reaction are adapted to produce, as an effect of the expansion of said quantity of fluid synthetic substance, a state of permanent tension on walls that delimit the cavity.

4. The method of claim 1, comprising, before said filling step, a first preparation step, during which first holes for connecting the cavity to an outside region are provided in a region of the body mass comprised between the cavity and a working surface located outside the body mass.

5. The method of claim 4, wherein said working surface is located above said cavity, said first holes running along directions which are vertical and/or inclined with respect to the vertical.

6. The method of claim 4, wherein during said filling step said filler material is introduced in said cavity through said first holes.

7. The method of claim 6, wherein during said filling step said filler material is introduced in said cavity through first pipes inserted in said first holes.

8. The method of claim 7, wherein a distance between two contiguous holes of said first holes ranges from 1 m to 20 m.

9. The method of claim 8, wherein said first holes have a diameter ranging from 15 mm to 300 mm.

10. The method of claim 9, wherein said first pipes have a diameter ranging from 10 to 250 mm.

11. The method of claim 1, wherein said filler material is constituted by material in the fluid state which can solidify after a preset time.

12. The method of claim 11, wherein a solidification time of said filler material ranges from 30 seconds to 24 hours.

13. The method of claim 11, wherein said filler material in the fluid state has a density ranging from 20 $kg/m^3$ to 2400 $kg/m^3$.

14. The method of claim 11, wherein said filler material, after solidification, has a simple compressive strength ranging from 1.5 $kg/cm^2$ to 500 $kg/cm^2$.

15. The method of claim 11, wherein said filler material, after solidification, has a modulus of deformation ranging from 30 $kg/cm^2$ to 400,000 $kg/cm^2$.

16. The method of claim 11, wherein said filler material is constituted by concrete.

17. The method of claim 1, wherein said filler material is constituted by inert material in the solid state in granules.

18. The method of claim 17, wherein said filler material is introduced in said cavity by mixing with a conveyance fluid.

19. The method of claim 17, wherein said filler material has a density ranging from 200 $kg/m^3$ to 2000 $kg/m^3$.

20. The method of claim 17, wherein the simple compressive strength of the granules of said filler material ranges from 5 $kg/cm^2$ to 2000 $kg/cm^2$.

21. The method of claim 17, wherein an angle of internal friction of said filler material ranges from 20° to 45°.

22. The method of claim 17, wherein a modulus of deformation of said filler material ranges from 250 $kg/cm^2$ to 800,000 $kg/cm^2$.

23. The method of claim 17, wherein a size of the granules of said filler material ranges from 0.001 mm to 50 mm.

24. The method of claim 17, wherein said filler material is constituted by sand and/or gravel.

25. The method of claim 17, wherein said filler material is constituted by expanded clay.

26. The method of claim 17, wherein said filler material is constituted by waste of industrial processes.

27. The method of claim 4, comprising, before said saturation step, a second preparation step during which second holes are formed, starting from said working surface, that lead into said cavity above said filler material and/or into said filler material.

28. The method of claim 27, wherein said second holes lie along a direction which is vertical and/or inclined with respect to the vertical.

29. The method of claim 28, wherein during said saturation step said synthetic substance is introduced in said cavity through said first holes and/or through said second holes.

30. The method of claim 29, wherein during said saturation step, said synthetic substance is introduced in the cavity by pumping through second pipes inserted in said first holes and/or through said second holes.

31. The method of claim 29, wherein a distance between two contiguous holes of said second holes ranges from 1 m to 20 m.

32. The method of claim 29, wherein said second holes have a diameter ranging from 10 mm to 100 mm.

33. The method of claim 30, wherein said second pipes have a diameter ranging from 6 mm to 50 mm.

34. The method of claim 30, wherein said synthetic substance has a potential volume expansion ranging from 2 to 30 times a volume thereof before expansion.

35. The method of claim 29, wherein said synthetic substance has a potential volume expansion ranging from 10 to 30 times a volume thereof before expansion.

36. The method of claim 34, wherein a maximum expansion pressure generated by said synthetic substance is higher than a pressure produced by a weight of the filler material that is present above an outlet of said second pipes.

37. The method of claim 35, wherein the maximum expansion pressure of said synthetic substance, in fully confined conditions, ranges from 200kPa to 20,000 kPa.

38. The method of claim 36, wherein the maximum expansion pressure of said synthetic substance, in fully confined conditions, is higher than 500 kPa.

39. The method of claim 36, wherein said synthetic substance is a substance with two components which are premixed and pumped into the cavity.

40. The method of claim 36, wherein a pressure with which said synthetic substance is pumped into said cavity ranges from 5 bars to 30 bars.

41. The method of claim 36, wherein a reaction time of said synthetic substance ranges from 2 seconds to 80 seconds.

42. The method of claim 36, wherein a reaction time of said synthetic substance ranges from 2 seconds to 15 seconds.

43. The method of claim 41, wherein a viscosity of said synthetic substance, before the chemical reaction for expansion, ranges from 100 mPa·s to 700 mPa·s at a temperature of 25° C.

44. The method of claim 42, wherein a viscosity of said synthetic substance reaches a value which tends to infinity over a time interval ranging from 5 seconds to 80 seconds starting from a beginning of the chemical reaction for expansion.

45. The method of claim 36, wherein said synthetic substance is constituted by a closed-cell polyurethane foam.

46. The method of claim 36, wherein said synthetic substance is constituted by an MDI isocyanate and by a mixture of polyols.

47. The method of claim 41, wherein said synthetic substance has a density, at an end of the chemical reaction for expansion and setting, in an absence of confinement, of 30 $kg/m^3$.

48. The method of claim 47, wherein said synthetic substance has a density, at an end of the chemical reaction for expansion and setting, in fully confined conditions, of 1200 $kg/m^3$.

49. The method of claim 47, wherein said synthetic substance has a density, at an end of the chemical reaction for expansion and setting, in confinement conditions occurring during use, ranging from 50 $kg/m^3$ to 200 $kg/m^3$.

50. The method of claim 47, wherein said synthetic substance, after the chemical reaction for expansion and setting, in confinement conditions occurring during use, has a tensile strength ranging from 0.3 MPa to 1.9 MPa for densities ranging from 50 $kg/m^3$ to 200 $kg/m^3$.

51. The method of claim 47, wherein said synthetic substance, after the chemical reaction for expansion and setting, in confinement conditions occurring during use, has a compressive strength ranging from 0.2 MPa to 2.4 MPa for densities ranging from 50 $kg/m^3$ to 200 $kg/m^3$.

52. The method of claim 42, wherein said synthetic substance, after the chemical reaction for expansion and setting, in confinement conditions occurring during use, has a modulus of elasticity ranging from 10 MPa to 50 MPa for densities ranging from 50 $kg/m^3$ to 200 $kg/m^3$.

53. The method of claim 1, wherein said pressure measurement is performed by way of pressure measurement units, which are inserted in said cavity through said first holes and are arranged on an intrados of the cavity.

54. The method of claim 4, comprising a preliminary step for measuring said cavity to be filled.

55. The method of claim 54, wherein said preliminary measurement step comprises a step of inspecting said cavity by way of a television camera.

56. The method of claim 54, wherein said preliminary measurement step comprises a measurement of said cavity to be filled by way of a laser rangefinder.

57. The method of claim 54, wherein said preliminary measurement step is performed before said filling step by inserting measurement instruments into said cavity through said first holes.

58. A method for saturating cavities present in a body mass comprising:

at least one step of at least partial filling of a cavity by introducing a filler material into the cavity;

at least one step of saturating the cavity by introducing into said cavity a quantity of a fluid synthetic substance which expands and sets by chemical reaction and is adapted to generate, as a consequence of its expansion, at least the saturation of the cavity and a compaction and/or loading of said filler material introduced into the cavity in said filling step, wherein said filler material is constituted by inert material in the solid state in granules constituted by expanded clay.

59. A method for saturating cavities present in a body mass comprising:

at least one step of at least partial filling of a cavity by introducing a filler material into the cavity;

at least one step of saturating the cavity by introducing into said cavity a quantity of a fluid synthetic substance which expands and sets by chemical reaction and is adapted to generate, as a consequence of its expansion, at least the saturation of the cavity and a compaction and/or loading of said filler material introduced into the cavity in said filling step, wherein said filler material is constituted by inert material in the solid state in granules having a density ranging from 200 $kg/m^3$ to 2000 $kg/m^3$ and a viscosity of said synthetic substance, before the chemical reaction for expansion, that ranges from 100 mPa·s to 700 mPa·s at a temperature of 25° C.

* * * * *